US010280026B2

(12) United States Patent
Pettersson et al.

(10) Patent No.: US 10,280,026 B2
(45) Date of Patent: May 7, 2019

(54) DEVICE FOR CONTROLLING TENSION IN A WEB OF PACKAGING MATERIAL

(71) Applicant: TETRA LAVAL HOLDINGS & FINANCE S.A., Pully (CH)

(72) Inventors: Thomas Pettersson, Stockamöllan (SE); Ingvar Andersson, Löddeköpinge (SE); Peter Öhman, Lund (SE)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 125 days.

(21) Appl. No.: 15/312,499

(22) PCT Filed: May 13, 2015

(86) PCT No.: PCT/EP2015/060578
§ 371 (c)(1),
(2) Date: Nov. 18, 2016

(87) PCT Pub. No.: WO2015/177018
PCT Pub. Date: Nov. 26, 2015

(65) Prior Publication Data

US 2017/0121141 A1 May 4, 2017

(30) Foreign Application Priority Data

May 19, 2014 (SE) ..... 1450578

(51) Int. Cl.
*B65H 23/16* (2006.01)
*B65H 23/04* (2006.01)
*B65H 23/188* (2006.01)

(52) U.S. Cl.
CPC ..... *B65H 23/048* (2013.01); *B65H 23/16* (2013.01); *B65H 23/1888* (2013.01);
(Continued)

(58) Field of Classification Search
CPC .. B65H 23/048; B65H 23/16; B65H 23/1888; B65H 2301/3112
See application file for complete search history.

(56) References Cited

U.S. PATENT DOCUMENTS 3,338,489 A * 8/1967 Ranson ..... G06K 13/22 226/195
3,904,145 A 9/1975 Steinberger et al.
(Continued)

FOREIGN PATENT DOCUMENTS

CN 102413957 A 4/2012
DE 456 250 A 2/1928
(Continued)

OTHER PUBLICATIONS

International Search Report (PCT/ISA/210) dated Aug. 28, 2015, by the European Patent Office as the International Searching Authority for International Application No. PCT/EP2015/060578.
(Continued)

*Primary Examiner* — Sang K Kim
(74) *Attorney, Agent, or Firm* — Buchanan Ingersoll & Rooney PC

(57) ABSTRACT

An arrangement for controlling longitudinal forces acting on a web of packaging material being wound from a first reel to a second reel, said arrangement comprising a first roller having a first rotational axis and a second roller having a second rotational axis, wherein the first rotational axis is fixed while the second rotational axis is movable.

18 Claims, 3 Drawing Sheets

(52) U.S. Cl.
CPC *B65H 2301/3112* (2013.01); *B65H 2301/522* (2013.01); *B65H 2301/543* (2013.01); *B65H 2402/31* (2013.01); *B65H 2404/144* (2013.01); *B65H 2511/212* (2013.01); *B65H 2701/1944* (2013.01)

(56) References Cited

U.S. PATENT DOCUMENTS

| | | | | |
|---|---|---|---|---|
| 4,025,005 | A | 5/1977 | Fleck et al. | |
| 4,283,024 | A | 8/1981 | Sienkiewicz | |
| 5,825,374 | A | 10/1998 | Albertalli et al. | |
| 5,921,453 | A | 7/1999 | Suzuki | |
| 6,352,257 | B1 | 3/2002 | Todaro et al. | |
| 6,379,291 | B1 | 4/2002 | Wild et al. | |
| 2004/0140387 | A1 | 7/2004 | Ishida et al. | |
| 2010/0202818 | A1 | 8/2010 | Fuchs et al. | |
| 2010/0243698 | A1* | 9/2010 | Hashimoto | B65H 23/048 226/21 |
| 2012/0018564 | A1 | 1/2012 | Schmitz | |
| 2015/0102152 | A1* | 4/2015 | Duehring | B65H 23/048 242/419.1 |

FOREIGN PATENT DOCUMENTS

| | | | |
|---|---|---|---|
| DE | 19 59 065 | A1 | 7/1970 |
| DE | 20 2009 009097 | U1 | 11/2009 |
| EP | 0 464 616 | A1 | 1/1992 |
| JP | S55-027671 | U | 2/1980 |
| JP | H02-123060 | A | 5/1990 |
| JP | 2006-027814 | A | 2/2006 |
| JP | 2010-042898 | A | 2/2010 |
| RU | 2167767 | C2 | 5/2001 |
| WO | 2010124969 | A1 | 11/2010 |

OTHER PUBLICATIONS

Written Opinion (PCT/ISA/237) dated Aug. 28, 2015, by the European Patent Office as the International Searching Authority for International Application No. PCT/EP2015/060578.

International Type Search Report (PCT/ISA/201) dated Dec. 19, 2014, by the Swedish Patent Office as the International Searching Authority for International Application No. IT/SE14/00116.

"Web Threading and Tensioning Guide Apparatus", Research Disclosure, No. 294, pp. 764-767 , Oct. 1, 1988, XP000097401.

Office Action (Notification of Reasons for Refusal) dated Dec. 18, 2018, by the Japanese Patent Office in corresponding Japanese Patent Application No. 2016-568600, and an English Translation of the Office Action. (6 pages).

Search Report from Office Action issued by the Russian Patent Office dated Dec. 14, 2018 in corresponding Russian Patent Application No. 2016149493 (2 pages).

* cited by examiner

DEVICE FOR CONTROLLING TENSION IN A WEB OF PACKAGING MATERIAL

TECHNICAL FIELD

The present invention relate to the field of web handling, and in particular control of the tension of a web of packaging material as used in a machine for processing a web of packaging material. The disclosure relates to a device as well as to a method for said control.

TECHNICAL BACKGROUND

Within the field of packaging technology use is often made of consumer packages configured for single use. Such packaging container may be manufactured from a laminated packaging material comprising a paper or cardboard core and outer protecting layers or coatings of a plastic such as polyethylene. The plastic layers provide protects the core from moisture emanating from the product inside the packaging container or from the outside of the packaging container. The packaging laminate may also comprise further layers adapted to provide a barrier against passage of gases such as oxygen, or a barrier against passage of light. One such further layer may be a metallic foil arranged between the core and at least one of the moisture barriers. Aluminium foil is commonly used. Optionally the core may be replaced by a non-cellulose material. It is worth stressing that the area of packaging laminate is a field of research continuously developing and since the present disclosure does not relate to the packaging laminate as such it will not be discussed any further. The application of the present disclosure should not be limited to the example given, but rather the invention may be used in the processing of any packaging laminate.

A packaging container made from a packaging laminate is a well known product to most people. In a modern processing line such a packaging container is manufactured and filled in a packaging line or filling line, were packaging laminate from a reel or in the form of individual blanks are fed to a machine in one end thereof and filled containers made from the packaging laminate exits in the other end. In the filling line the packaging laminate has been formed, filled and sealed, to make a long story short. As was the case for the packaging laminate, the field of filling lines is a vast area on its own, and not the prime issue for the present disclosure. Still, in one example, a web of packaging material is fed to a filling machine. In the filling machine the web is formed into a tube and its longitudinal edges are sealed to one another, forming a hollow cylinder having a longitudinal seal. The hollow cylinder is gradually filled with pourable product and by performing transversal sealing below a product level in the tube a chain of pillow-shaped, filled, packaging containers is formed. The chain may then be severed into individual packaging containers which are formed into, e.g. packaging containers having a parallelepiped shape. Examples of such a container is Tetra Brik. If every other transversal seal is shifted 90° the renowned container Tetra Classic may be formed. In other concepts individual blanks—rather than a web of packaging material fed from a reel—are fed to the filling line. A magazine feeds the blanks one by one into the filling line, where each blank is folded into a packaging container which is sealed at one end. After the packaging container has been filled it is sealed and folded at its other end. Typical packaging containers within this concept is the Tetra Rex and the Tetra Top.

Moving closer to the field of the present invention; a laminated packaging material, or packaging laminate, of the type described above is manufactured in industrial scale from a web of paper or carton being formed into a roll. The web (i.e. the free end of the roll) is guided to a first processing station where one side thereof is provided with a repetitive décor or pattern of aesthetic or informative character, using a suitable printing technique of which there is a few. In the same processing station or in an adjacent processing station the web is provided with a likewise repetitive pattern of weakening lines. The purpose of the weakening lines, or crease lines, may be to facilitate folding of the packaging containers formed from the packaging material at a later stage. The décor and the pattern of crease lines should of course be in register with each other for every formed packaging container to have the same appearance.

In subsequent processing stations the web is provided with the barrier layers of plastic and/or foil.

The order of processing steps may vary; in some concepts the printing is performed after the barrier layers have been arranged, just to mention one example.

At this stage in the process the web has a width corresponding to several packaging containers, and this web is divided longitudinally into "one-package width webs", or sub webs, which are rolled into rolls for later use in a filling line. In the following the word "web" will mostly refer to these sub-webs, but as a general principle the technique to be disclosed may as well be applied on the original larger web, or on a different web altogether.

During the entire process the quality of the packaging laminate is monitored, such that physical or cosmetic errors may be accounted for. Each serious flaw is registered and in a separate process the web of packaging material is "doctored", meaning that a defect segment of the web is removed after which the formed free ends are spliced together for formation of a continuous web. In this way there is a reduced risk of problems later on in a filling line using the web of packaging material.

A doctoring line used for the above purpose, of a conventional design, has a first horizontal rotatable shaft at one end thereof and a corresponding second horizontal rotatable shaft at the other end thereof. The web of packaging material is arranged on a reel on the rotatable shaft at the first end, is guided through the doctoring line and wound up on a reel arranged on the second rotatable shaft. In the doctoring line there is equipment arranged to locate detected errors and to remove segments of the web and splice the formed free ends together. The web is wound from the first reel to the second reel, and when an error is located the web is stopped and a doctoring sequence is commenced, after which the winding starts over. For one single roll of packaging laminate the doctoring sequence may be initiated repeatedly, and in each doctoring sequence a segment of the web will be wasted.

A doctoring line is often a complex construction of rolls and reels, as well as nips and brakes for the web to pass through, and when a new roll of packaging material is arranged on the first reel a leading end of the web needs to be thread through the doctoring line.

One section of the doctoring line is a "pull and brake" arrangement. One objective of a pull and brake arrangement is to master the web transport, by controlling the web speed. An existing pull and brake arrangement is shown in FIG. 8. The arrangement comprises four rollers, three of which have fixed rotational axes. The first and the second rollers are arranged on the same height, while the second roller is shifted downwards on a centreline between the first and the third roller. Notably and obviously up/down, left/right etc are given as example only, in order to facilitate understanding of one prior art arrangement. The web is thread over the first roller, under the second roller and over the third roller, essentially being formed as a U. Below the second roller a fourth roller is arranged. The fourth roller is movable in the up/down direction, and it is used to clamp the web of packaging material between the second roller and the fourth roller with a variable force. Through variation of the force the tension in the web of packaging material may be controlled. Understandably, threading of such a pull and brake arrangement is a complex procedure, and since there is a need to perform that operation at least once per roll of packaging material there is a considerable effort put into it.

One purpose of the present disclosure is to provide an improved pull and brake arrangement facilitating threading of a doctoring line, or at least a pull and brake arrangement thereof. An effect of the novel arrangement, according to some embodiments thereof, is that the handling of waste formed in the doctoring procedure is significantly simplified.

SUMMARY

The present disclosure, according to one aspect thereof, relates to an arrangement for controlling longitudinal forces acting on a web of packaging material being wound from a first reel to a second reel, said arrangement comprising a first roller having a first rotational axis and a second roller having a second rotational axis. In the arrangement the first rotational axis is fixed while the second rotational axis is movable, resulting in several advantageous effects to be further described in the detailed description, as well as below.

In one or several embodiments the second rotational axis may be movable along a segment of a circular arc, and in still other and related embodiments a central point of the circular arc may coincide with the first rotational axis. This will enable the second roller to be moved along a circular arc in a symmetric way around the first roller. In one or several embodiments a radius of the circular arc corresponds to about a sum of a radius of the first roller and the radius of the second roller, and optionally a thickness of the web of packaging material. This enables for the second roller to move while at all times being in contact with the first roller, or for the first roller to be in contact with the second roller at several positions around its periphery.

In one or more embodiments the second rotational axis may also be movable along a rectilinear path. This enables for the second roller to move out of and into contact or engagement with the first roller. In one or several related embodiments the rectilinear path may have an extension along a radius extending from the first rotational axis.

One or several of the above features may be enabled by suspending the second roller to be moved along a rectilinear path on a mechanism, wherein the mechanism in turn is arranged to be rotatable around the first rotational axis. In this manner the two movements, the circular and the linear, respectively, may be decoupled and readily accomplished.

According to a second concept the present disclosure relates to web processing line comprising the arrangement of any preceding claim, wherein in the web is configured to, in a threading position, follow a rectilinear path past the arrangement, while in an operative position the web is arranged to engage with the arrangement, wherein a switch from the treading position to the operative position is enabled by the arrangement, i.e. by movement of the second roller. In one or more embodiments the web processing line is a doctoring line.

According to a third concept the present disclosure relates to a method for controlling an arrangement of any previous or following description during operation of a web processing line. The method may comprise: arranging the second roller one first side of the first roller, the rollers not being in contact, arranging a web of material to follow a rectilinear path passing between the first roller and the second roller, translating the second rotational axis along a rectilinear path and along a circular path such that the second roller is arranged on a second side of the first roller, the second side being opposite to the first side. Now the first and second rollers are arranged in an operative position. The method may be performed in any order, e.g. the rectilinear movement may be performed before, during or after the movement along a circular path, and the order of events may be the reverse, i.e. movement from an operative position to a threading position, or vice versa. In the detailed description there is also a disclosure of a waste position, which also may form part of an embodiment of the present disclosure as claimed.

BRIEF DESCRIPTION OF THE DRAWINGS

All drawings are schematic drawings having the purpose of illustrating the operational principle of the present invention.

DETAILED DESCRIPTION

Figure 1:
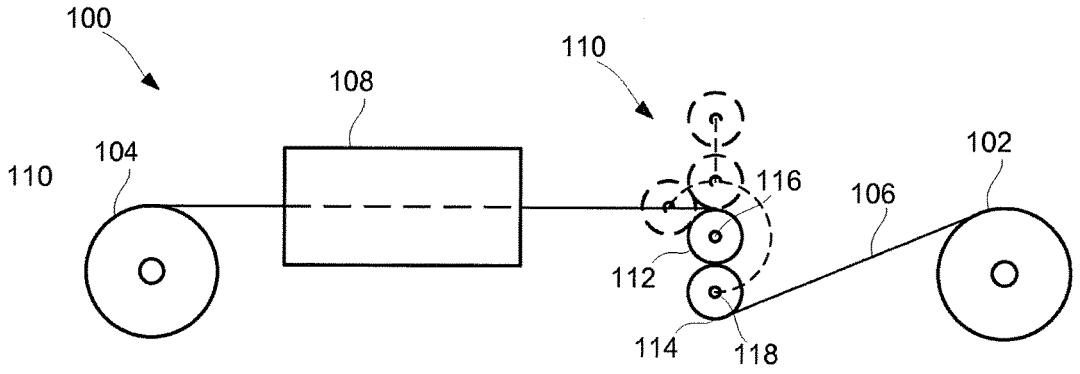
FIG. 1 is a side view of a doctoring line having a pull and brake arrangement according to a first embodiment of the present invention, in a winding mode thereof.

A doctoring line 100 is shown in FIG. 1. The doctoring line has a first rotational shaft or reel 102 and a second rotational shaft or reel 104. A web of packaging material 106 is wound from the first reel 102 to the second reel 104, and in a doctoring station indicated by the rectangle 108 potential defects may be removed in a suitable manner. How the doctoring is performed will not be discussed in detail in the present disclosure, but for the small contribution that may be enabled by some embodiments of the present invention.

The present pull- and break arrangement 110 comprises a first roller 112 and a second roller 114, both being arranged to rotate around a first rotational axis 116 and a second rotational axis 118 respectively. During a doctoring process the operative position of the arrangement 110 is such that the web is guided along an S-shaped path through the arrangement. In the present setup the first roller 112 is arranged above the second roller 114. The web is guided below and around about half the second roller on the far side thereof, as seen from the first reel 102 before following the second roller around about half its circumference before continuing towards the doctoring station and the second reel.

A path of the web upstream the arrangement 110 and downstream thereof is such that if it was not for the second roller 114 the web would pass on a first side of the first roller while the second roller 114 is, in the operative position, is arranged on a second side of the roller, opposite to the first, thus enabling the S-shaped path.

The rotational axis of the first roller 112, the first rotational axis 116, may be statically arranged, while the rotational axis of the second roller 114, the second rotational axis 118 may be movably arranged. The movement of the second rotational axis, i.e. the movement of the second roller, will be described referring to the detail view of FIG. 2.

Figure 2:
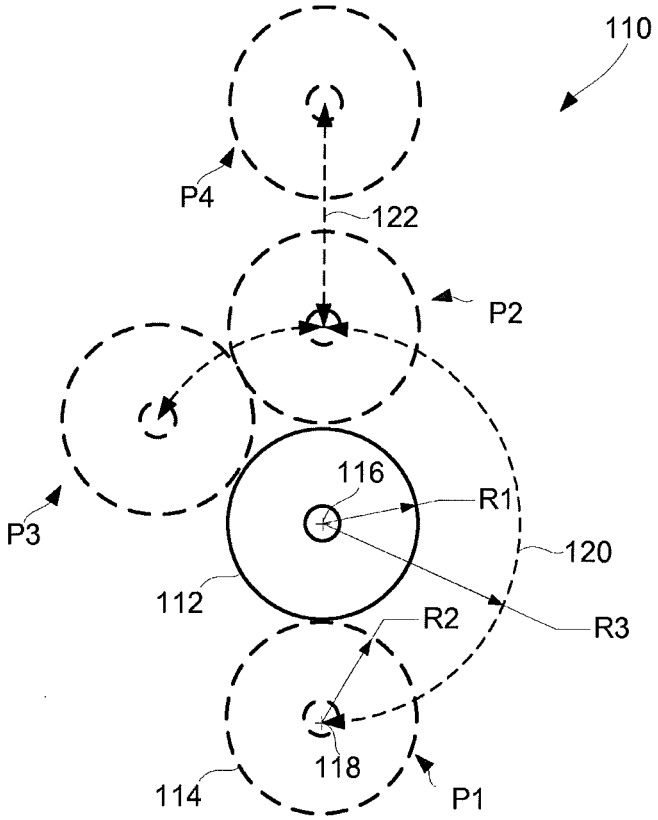
FIG. 2 is an isolated sideview of a pull and brake arrangement according to a first embodiment
Figure 8:
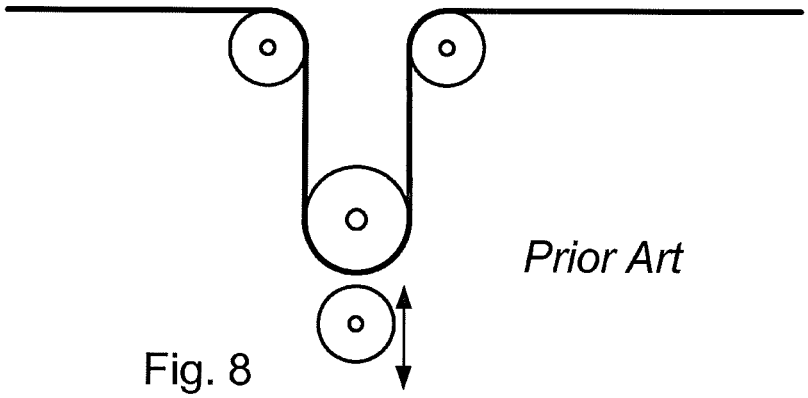
FIG. 8 is a detailed view of a pull and brake arrangement according to prior art.
Figure 5:
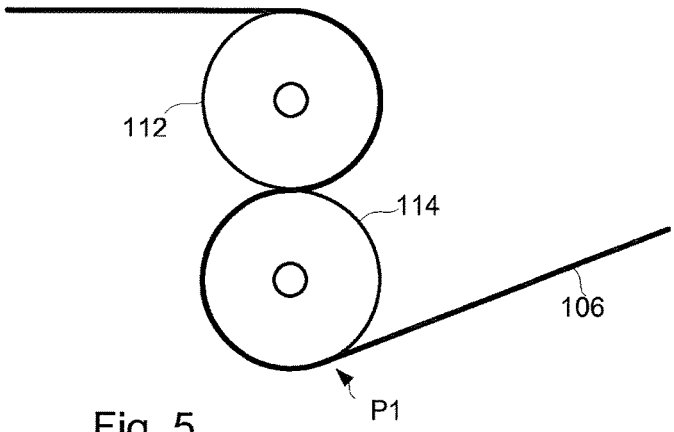
FIG. 5 is a detailed view of the pull and brake arrangement in the mode of FIG. 1.
Figure 6:
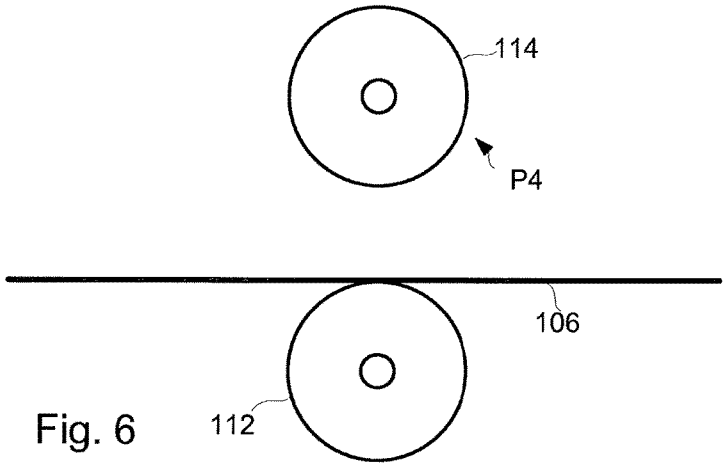
FIG. 6 is a detailed view of the pull and brake arrangement in the mode of FIG. 3.
Figure 7:
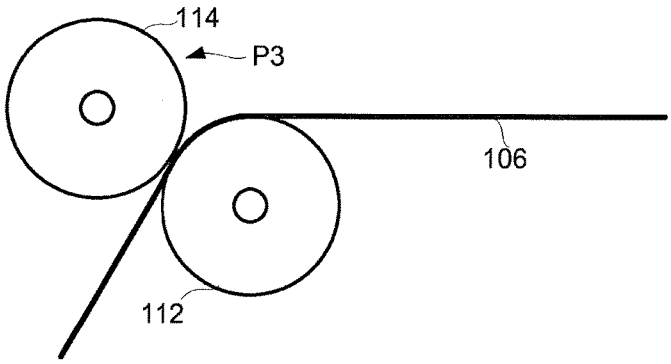
FIG. 7 is a detailed view of the pull and brake arrangement in the mode of FIG. 4.

FIG. 2 illustrates the first roller 112 in full lines while various positions for the second roller 114 are shown in dotted lines. There is a position P1 corresponding to the position as shown in FIG. 1; an "operative position". There is a position P2 which corresponds to an "engagement position" which is more of a position passed when moving between the other positions. There is a "waste position" P3 in which the arrangement will guide a passing web downwards. There is also a "thread position" in which the second roller 114 is fully disengaged with the first roller 112 such that a web may be conveniently arranged (or thread) through the arrangement 110 merely by following a rectilinear path. The first roller 112 is arranged to rotate around a first axis 116 and has a radius R1. The second roller 114 is arranged to rotate around a second axis 118 and has a radius R2. The first and the second roller are arranged in parallel, having parallel rotational axes. In one or more embodiments both rollers are suspended from one side axial thereof only, basically corresponding to the rotational axis of each roller having one end attached to a constructional arrangement while the second end is free.

Returning to FIG. 2 the second roller is movably arranged, such that it may be rotated from position P1 to position P2 merely by allowing for the second rotational axis to follow an arcuate path 120, i.e. a segment of a circular path. From position P2 the second roller may be rotated further to position P3, or it may be moved in a rectilinear direction along a rectilinear path 122 to position P4.

One convenient way of enabling such motion pattern is to arrange one end of the second roller on a sled (not shown) configured to perform a translational motion along a rectilinear direction on a plate or rail, which in turn is arranged to rotate around a rotational axis. The translational motion may be conducted by a servomotor, with a pneumatic cylinder a hydraulic cylinder, or with any other suitable arrangement. The rotational motion of the plate or rail may be conducted with any suitable drive, either acting directly on the rotational axis or on indirectly via a suitable linkage. It is readably understood how such an arrangement could enable the motion pattern has shown in FIG. 2. The movement is simplified if the rotational axis of the plate or rail coincides with the first rotational axis. The radius R3 of the path along which the second roller is moved corresponds to the sum of the radius R1 of the first roller and the radius R2 of the second roller, at least to a decent approximation. However, in a situation where the first roller is to be moved from the first position P1 to the fourth position P4 the radial movement may be performed prior to the rotational motion giving another radius.

A drive enabling the translational motion of the second axis may also be used to vary a force with which the second roller is pressed towards the first roller.

Figure 3:
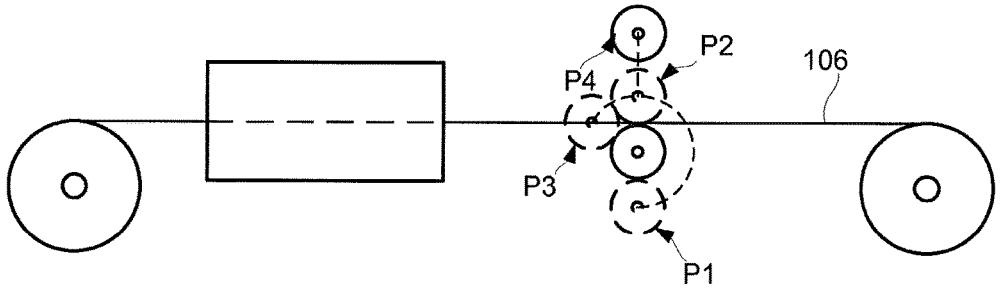
FIG. 3 is a side view of a doctoring line having a pull and brake arrangement according to a first embodiment of the present invention, in a threading mode thereof.

FIG. 3 is a view illustrating the position of the second roller in a threading operation, i.e. when a free end of a web of packaging material is to be guided through the doctoring arrangement and the pull- and break arrangement in particular, for the first time. Prior to threading the second roller is moved to position P4. When arranged in position P4 it will be possible to pull the web of packaging material through the arrangement along a rectilinear path. It is readily understood that if the second roller would have been in the operative position P1 the manoeuvre of threading would be more cumbersome. After the web has been pulled through the arrangement the second roller may be moved to position P2, clamping the web between the first and second roller. Thereafter the second roller may be rotated down to the operative position P1, thus concluding the threading operation.

Figure 4:
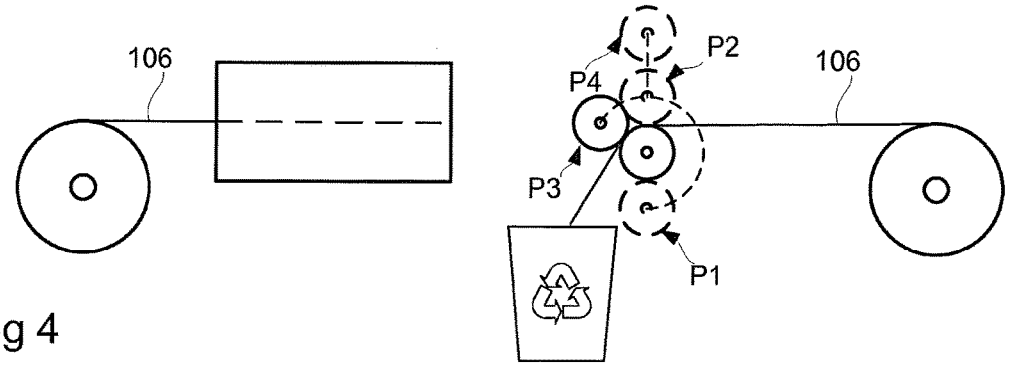
FIG. 4 is a side view of a doctoring line having a pull and brake arrangement according to a first embodiment of the present invention, in a wasting mode thereof.

In the view of FIG. 4 the second roller has been arranged in the waste position P3. In this position the second roller is in contact with the first roller, with the intermediate of the web 106, and the tangent of the contact is directed downwards, enabling guiding of the web in an alternative direction. In the present embodiment the web is directed towards a waste assembly schematically indicated by the recycling bin. Wasting of packaging material may be the first operation after threading of a web. This means that the first roller is moved from the position P4, to position P2, and then to the waste position P3. One other example could be that the second roller is moved from the first position P1 directly to the waste position P3. No matter the scenario the present arrangement nevertheless enables the second roller to assume the position P3.

Some features as associated effects have been described in the detailed description, referring also to the drawings. The description has been detailed, but it should still not be construed as limiting to a general concept of the invention as defined by the appended claims. The skilled person will, from the enabled embodiments and the associated description, be able to construct new embodiments vis-à-vis the embodiments being having been described without departing from the scope of the appended claims.

The invention claimed is:

1. An arrangement for controlling longitudinal forces acting on a web of packaging material being wound from a first reel to a second reel, said arrangement comprising:

a first roller having a first rotational axis and a second roller having a second rotational axis, the first rotational axis being fixed while the second rotational axis is movable, the second rotational axis being arranged on a first side of the first roller, the first and second rollers not being in contact, the second rotational axis being movable along a rectilinear and a circular path such that the second roller is movable to a second side of the first roller, the second side of the first roller being opposite the first side of the first roller.

2. The arrangement of claim 1, wherein the circular path comprises a segment of a circular arc.

3. The arrangement of claim 2, wherein a central point of the circular arc coincides with the first rotational axis.

4. The arrangement of claim 3, wherein a radius of the circular arc corresponds to about a sum of a radius of the first roller and a radius of the second roller.

5. The arrangement of claim 3, wherein a radius of the circular arc corresponds to about a sum of a radius of the first roller a radius of the second roller, and a thickness of the web of packaging material.

6. The arrangement of claim 1, wherein the rectilinear path has an extension along a radius extending from the first rotational axis.

7. A web processing line that subjects a web of packaging material to processing steps, the web processing line comprising the arrangement of claim 1, wherein the web of packaging material is configured to, in a threading position, follow a rectilinear path between the first and second rollers, while in an operative position the web of packaging material is arranged to engage with the first and second rollers, wherein a switch from the treading position to the operative position is enabled by the movement of the second roller along the rectilinear path and the circular path.

8. The web processing line of claim 7, wherein the web processing line is a web doctoring line.

9. A method for controlling longitudinal forces acting on a wed of packaging material being wound from a first reel to a second reel, comprising arranging a second roller on a first side of a first roller while the first and second rollers are not in contact with one another, the first roller being rotatable about a first rotational axis and the second roller being rotatable about a second rotational axis, arranging the web of material to follow a rectilinear path passing between the first roller and the second roller while the first and second rollers are not in contact with one another, translating the second rotational axis along a rectilinear path and along a circular path to move the second roller to a second side of the first roller that is opposite the first side of the first roller.

10. An arrangement forming part of a machine that processes a web of packaging material to control longitudinal forces acting on the web of packaging material as the web of packaging material is fed along a path from a first reel to a second reel, the arrangement comprising:

a first roller rotatable about a fixed first rotational axis;

a second roller rotatable about a movable second rotational axis that is movable along a roller path spaced from the first rotational axis;

the second roller being movable along the roller path: i) from an operative position in which the second roller is in engagement with the first roller and the web is in contact with and guided around a portion of the first roller and a portion of the second roller to an engagement position in which the second roller is in engagement with the first roller and the web passes between the first and second rollers; and ii) from the engagement position to a thread position in which the second roller is disengaged from the first roller and the web passes between the first roller and the second roller.

11. The arrangement of claim 10, wherein a part of the roller path is an arcuate roller path.

12. The arrangement of claim 11, wherein the arcuate roller path is a circular arc possessing a rotational center that coincides with the first rotational axis.

13. The arrangement of claim 10, wherein the roller path includes a first part along which the second roller moves from the operative position to the engagement position and a second part along which the second roller moves from the engagement position to the thread position, the second part of the roller path being rectilinear.

14. The arrangement of claim 13, wherein the second part of the roller path that is rectilinear is positioned along a radius extending from the first rotational axis.

15. The arrangement of claim 13, wherein the roller path includes a first part along which the second roller moves from the operative position to the engagement position and a second part along which the second roller moves from the engagement position to the thread position, the first part of the roller path being a circular arc.

16. The arrangement of claim 15, wherein the circular arc possesses a rotational center coinciding with the first rotational axis.

17. The arrangement of claim 10, wherein the roller path includes a first part along which the second roller moves from the operative position to the engagement position and a second part along which the second roller moves from the engagement position to the thread position, the first and second parts of the roller path possessing different shapes, the first part of the roller path being a circular arc.

18. The arrangement of claim 17, wherein the circular arc possesses a rotational center coinciding with the first rotational axis.

* * * * *